313-414 SR

11/4/80 OR 4,232,246

United States Patent [19]

Sakurai et al.

[11] 4,232,246

[45] Nov. 4, 1980

[54] ELECTRON GUN ASSEMBLY FOR A COLOR PICTURE TUBE

[75] Inventors: Soichi Sakurai, Mobara; Kunio Ando, Yokohama; Kenichi Fukuzawa, Mobara, all of Japan

[73] Assignee: Hitachi, Ltd., Japan

[21] Appl. No.: 877,862

[22] Filed: Feb. 15, 1978

[30] Foreign Application Priority Data

May 25, 1977 [JP] Japan ..... 52/59766

[51] Int. Cl.[3] ..... H01J 29/50

[52] U.S. Cl. ..... 313/414

[58] Field of Search ..... 313/409, 414, 412

[56] References Cited

U.S. PATENT DOCUMENTS

| | | | |
|---|---|---|---|
| 3,294,999 | 12/1966 | Van Hekken | 313/414 |
| 3,987,328 | 10/1976 | Yoshida et al. | 313/414 |
| 4,028,581 | 6/1977 | Stratton | 313/414 |

FOREIGN PATENT DOCUMENTS 50-67549 6/1975 Japan .

*Primary Examiner*—Palmer C. Demeo

*Attorney, Agent, or Firm*—Craig & Antonelli

[57] ABSTRACT

Improvements in an electron gun assembly for a color picture tube comprising three electron guns arranged in an in-line relation, each of said three electron guns having three grid electrodes which have respective cylindrical portions of the same inside diameter and are arranged spacedly from each other on the same axis, and the non-central two of which are kept at the same electric potential. At least one of the non-central two grid electrodes is not required to be provided with an inner electrode so that it consists only of cap electrodes, and height i.e. the axial length of the inside cylinders of the respective cap electrodes of the non-central electron guns and the central electron guns are selected to be individually less than the inside diameter (D) of the electrodes.

5 Claims, 4 Drawing Figures

ELECTRON GUN ASSEMBLY FOR A COLOR PICTURE TUBE

LIST OF PRIOR ART REFERENCES (1) TOKKAISHO (Laid-Open Japanese Patent Application No. 105068/75.
Laid-Open Date: Aug. 19, 1975

(2) TOKKAISHO (Laid-Open Japanese Patent Application No. 67549/75.
Laid-Open Date: June 6, 1975

FIELD OF THE INVENTION

The present invention relates to an electron gun assembly for a color picture tube comprising three electron guns arranged in an in-line relationship by which an electron beam spot is formed on the fluorescent surface of a cathode-ray tube.

DESCRIPTION OF THE PRIOR ART

Figure 1:
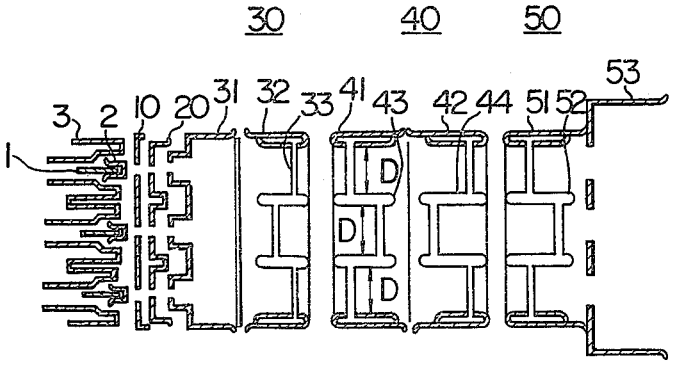
FIG. 1 PRIOR ART
FIG. 1 is a cross-sectional view illustrating generally a conventional electron gun.

FIG. 1 shows one example of the electrode arrangement in a prior art electron gun. In FIG. 1, on the left side, a heater 1 and a cathode 2 are fixed through a cathode support 3 to the inside of an insulating glass (not shown). To the right side of the cathode 2, there are provided successively and a little spacedly a first grid electrode 10, a second grid electrode 20, a third grid electrode 30, a fourth grid electrode 40, and a fifth grid electrode 50. The third, fourth, and fifth grid electrodes form the so-called main-focussing lens system for each electron gun between the cathode 2 and the anode (not shown). The third grid electrode 30 includes a third grid bottom electrode 31, a third grid cap electrode 32 and a third grid inner electrode 33 provided between the former electrodes. The fourth grid electrodes 40 includes fourth grip cap electrodes 41 and 42 and fourth grid inner electrodes 43 and 44. Further, the fifth grid electrode 50 has a fifth grid cap electrode 51 and a fifth grid inner electrode 52 which are fixed to a shield cap 53. In side these three electrodes 30, 40 and 50 are formed as cylindrical portions of the same inside diameter D which are arranged to form a substantially electron-optically complete optoelectronic cylinder so that the shape of the beam spot is kept as a substantially perfect circle. Then, the third grid electrode 30 and the fifth grid electrode 50 are maintained at an equal electrical potential.

Thus, the conventional electron gun of the above-described constitution is required to have the respective cylindrical portions of the electrodes arranged in a complete cylinder. As a result, the third grid inner electrode 33 and the fifth grid inner electrode 52 are indispensable, which results disadvantageously in that a larger number of parts are needed for constituting the electrodes, thus causing the manufacturing cost to be high.

SUMMARY OF THE INVENTION

An object of the present invention is, in view of the above-mentioned circumstance, to reduce the manufacturing cost by simplifying the structure of the third or fifth grid electrode almost without deteriorating the circular shape of the beam spot, and further to provide an electron gun which can be easily subjected to an integral press work with respect to the third or fifth grid cap electrode.

DESCRIPTION OF THE PREFERRED EMBODIMENT

In the following, an embodiment of the present invention will be described with reference to the drawings.

Figure 2:
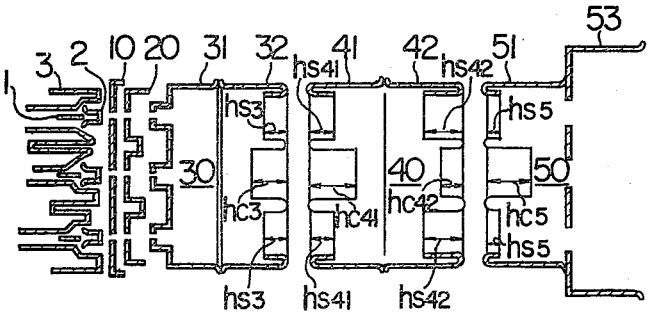
FIG. 2 is a cross-sectional view illustrating generally an electron gun used experimentally for obtaining basic data of the present invention.

FIG. 2 shows generally the constitution of an electron gun used experimentally for obtaining basic data of the present invention, in which the height of the respective inside cylinders of the third, fourth and fifth grid electrodes 30, 40 and 50 are designated by h with the center electron gun and the side electron guns being suffixed with c and s, respectively. The heater 1, the cathode 2, the cathode support 3, the first and second grid electrodes 10 and 20, and the third grid bottom electrode 31 are formed similarly to those shown FIG. 1. The third, fourth and fifth grid inner electrodes 33, 43, 44 and 52 in FIG. 1 are omitted in FIG. 2, and the heights $h_{c3}$ and $h_{s3}$ of the inside cylinders of the third grid cap electrode 32, the heights $h_{c41}$ and $h_{s41}$ of the inside cylinders of the fourth grid cap electrode 41 on the side of the third grid electrode 30, the heights $h_{c42}$ and $h_{s42}$ of the inside cylinders of the fourth grid cap electrode 42 on the side of the fifth grid electrode 50, and the heights $h_{c5}$ and $h_{s5}$ of the inside cylinders of the fifth grid cap electrode 51 are formed so as to be varied at will. Further, the above-mentioned inside cylinders are arranged on the corresponding common axes and have the same inside diameter D.

Figure 3:
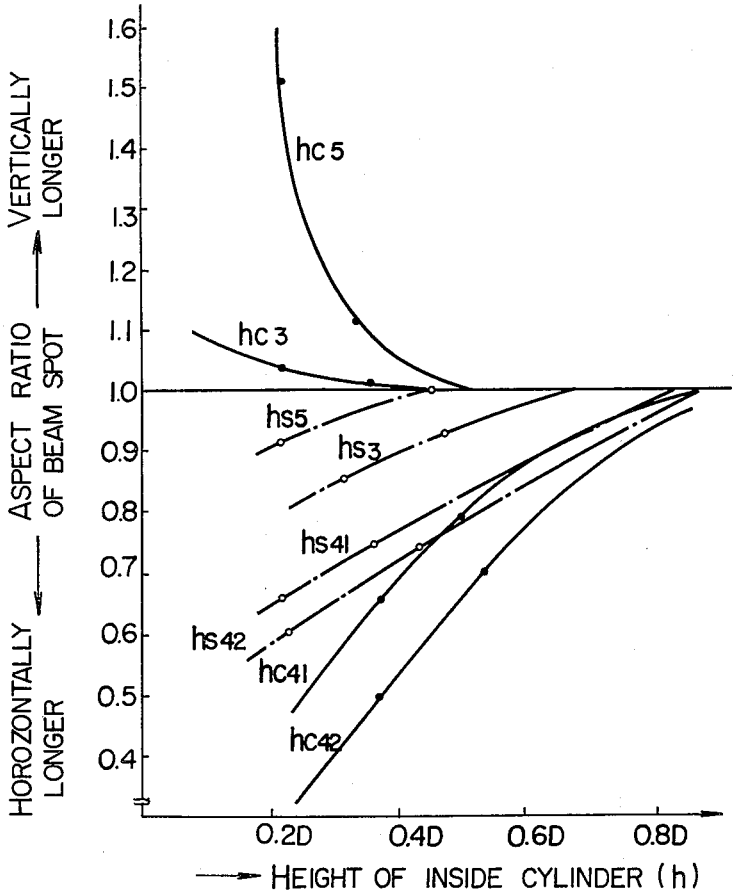
FIG. 3 is a graph showing height of inside cylinder versus beam spot aspect ratio characteristics of the third, fourth and fifth grid electrodes in the electron gun shown in FIG. 2.

FIG. 3 is a graph showing the experimental values of beam spot aspect ratio in dependence on the heights $h_{c3}$ and $h_{s3}$ of the inside cylinders of the third grid cap electrode 32, the heights $h_{c41}$ and $h_{s41}$ of the inside cylinders of the fourth grid cap electrode 41 on the side of the third grid electrode 30, the heights $h_{c42}$ and $h_{s42}$ of the inside cylinders of the fourth grid cap electrode 42 on the side of the fifth grid electrode 50, and the heights $h_{c5}$ and $h_{s5}$ of the inside cylinders of the fifth grid cap electrode 51. In FIG. 3, when one of the values of height $h_{c3}$, $h_{c41}$, $h_{c42}$ and $h_{c5}$ is varied, the other values are set to be more than 1.0D so as not to influence the beam spot aspect ratio. Similarly, when one of the values of height $h_{s3}$, $h_{s41}$, $h_{s42}$ and $h_{s5}$ is varied, the other values are set to be more than 1.0D so as not to influence the beam spot aspect ratio.

As apparent from FIG. 3, the heights of the inside cylinders of the third and fifth grid cap electrodes 32 and 51, $h_{c3}$, $h_{s3}$, $h_{c5}$ and $h_{s5}$ are correlated with each other, as described below. That is, in order to maintain the beam spot shape of the center electron gun to be a circle having an aspect ratio of 1.1 to 0.9, the heights $h_{c3}$ and $h_{c5}$ are required to be more than 0.07D and more than 0.35D, respectively. However, the beam spot aspect ratio depends on the heights $h_{c3}$ and $h_{c5}$ through the product of the individual aspect ratio. That is, when the heights $h_{c3}$ and $h_{c5}$ are set to be 0.37D, the respective aspect ratios are 1.02 and 1.08 as shown in FIG. 3. Thus, the beam spot aspect ratio is determined as their product $1.02 \times 1.08 \cong 1.10$. Since this value gives the upper limit of the allowable beam spot aspect ratio values i.e., allowable completeness of circle of the beam spot, an allowable beam spot aspect ratio can be obtained by setting the heights $h_{c3}$ and $h_{c5}$ to be more than 0.37D. Thus, it is satisfactory that the heights of the respective inside cylinders of the third and fifth grid cap electrodes 32 and 51, $h_{c3}$ and $h_{c5}$ are set to be more than 0.37D. Similarly, in order to maintain the beam spot aspect ratio of both the side electron guns to be 1.1 to 0.9, it is satisfactory that the heights $h_{s3}$ and $h_{s5}$ are set to be more than 0.41D and more than 0.2D, respectively, or both the heights $h_{s3}$ and $h_{s5}$ are set to be more than 0.43D, and thus it is not necessary to maintain these heights to be more than the inside diameter of the cylindrical portions D, as has usually been assumed.

On the other hand, with respect to the heights of the respective inside cylinders of the fourth grid cap electrodes 41 and 42, $h_{c41}$, $h_{s41}$, $h_{c42}$ and $h_{s42}$; the lower the heights $h_{c41}$, $h_{s41}$, $h_{c42}$ and $h_{s42}$ are, the wider the beam spot is liable to be, that is, the focusing characteristics of the entire surface of the color picture tube tend to be deteriorated. Thus, the heights $h_{c41}$, $h_{s41}$, $h_{c42}$ and $h_{s42}$ are required to be substantially more than the inside diameter of the cylindrical portions D.

Since, in general, the values of height of the inside cylinders of the grid cap electrodes 32, 41, 42 and 51, $h_{s5}$, $h_{c41}$, hHd s41, $h_{c42}$, $h_{s42}$, $h_{c5}$ and $h_{s5}$ cannot be made so large with regard to workability and mass-productivity; heretofore, the inner electrodes 33, 43, 44 and 52 and the cap electrodes 32, 41, 42 and 51 were combined, as shown in FIG. 1, to provide necessary heights of the respective inside cylinders. However, since, in accordance with the results shown in FIG. 3, the heights of the inside cylinders are not required to be so large at least with respect to the third grid electrode 30 and the fifth grid electrode 50, only the inside cylinders of the cap electrodes 32 and 51 can provide the necessary heights and thus the inner electrodes 33 and 52 which are otherwise necessary can be omitted.

Now, the center electron gun and the side electron guns will be considered with respect to the height of the inside cylinders of the respective cap electrodes. Since, as described above, $h_{s3} > 0.41D$ and $h_{c3} > 0.07D$ in the third grid cap electrode 32, the height of the inside cylinder of the center electron gun $h_{c3}$ can be made much lower than the height of the inside cylinders of the side electron guns $h_{s3}$, thus causing the integral press work to be much easier. Further, since $h_{c5} < 0.35D$ and $h_{s5} < 0.20D$ in the fifth grid cap electrode 51, the height of the inside cylinders of the side electron guns $h_{s5}$ can be made much lower than the height of the inside cylinder of the center electron gun $h_{c5}$, thus causing the integral press work to be much easier.

Figure 4:
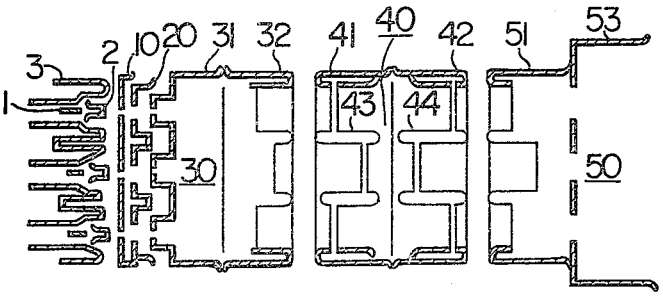
FIG. 4 is a cross-sectional view illustrating generally an embodiment of an electron gun according to the present invention.

The embodiment shown in FIG. 4 is based on such technical concept, that is, an electron gun which has both the third grid inner electrode 33 and the fifth grid inner electrode 52 in FIG. 1 being omitted. Of course, as is evident from the above description, only one of the third grid inner electrode 33 and the fifth grid inner electrode 52 may be omitted.

As is evident from the above description; in an electron gun according to the present invention, at least one of the third grid inner electrode 33 and the fifth grid inner electrode 52 shown in FIG. 1 can be made unnecessary without deteriorating the circular shape of the beam spot by forming both the side electrodes in such a manner that the height of the cylindrical portion of at least one of the side electrodes is less than the length of the corresponding perfect cylinder, tand thus the manufacturing cost can be reduced as a result of reduction in the number of parts.

We claim:

1. An electron gun assembly for a color picture tube comprising:

two side electron guns and a central electron gun sandwiched spacedly between said two side electron guns in an in-line relation; each of said central and said two side electron guns including a main focussing lens system comprised of a cathode side grid electrode, an anode side grid electrode and an intermediate grid electrode provided between said cathode side and said anode side grid electrodes, said cathode side and anode side grid electrodes being kept at the same electric potential; said cathode side, said anode side and said intermediate grid electrodes of said main focussing lens system of each of said central electron gun and said two side electron guns having a cylindrical portion of the same inside diameter, respectively; a height of said cylindrical portion of each of the intermediate grid electrodes being selected to be substantially larger than said inside diameter of said cylindrical portion, wherein a height ($h_{c3}$) of said cylindrical portion of said cathode side grid electrode of said central electron gun is selected to be $h_{c3} > 0.07D$ and a height ($h_{s3}$) of said cylindrical portion of said cathode side grid electrode of each of said two side electron guns is selected to be $h_{s3} > 0.41D$, where D is the inside diameter of the cylindrical portion, and further wherein said cathode side grid electrodes of said central and said two side electron guns are integrally formed only by means of a single cap electrode, without an inner electrode coupled to the cap electrode, so that the heights $h_{c3}$ and $h_{s3}$ are formed entirely by the cap electrode.

2. An electron gun assembly for a color picture tube comprising:

two side electron guns and a central electron gun sandwiched spacedly between said two side electron guns in an in-line relation; each of said central and said two side electron guns including a main focussing lens system comprised of a cathode side grid electrode, an anode side grid electrode and an intermediate grid electrode provided between said cathode side and said anode side grid electrodes, said cathode and anode side grid electrodes being kept at the same electric potential; said cathode side, said anode side and said intermediate grid electrodes of said main focussing lens system of each of said central electron gun and said two side electron guns having a cylindrical portion of the same inside diameter, respectively; a height of said cylindrical portion of each of the intermediate grid electrodes being selected to be substantially larger than said inside diameter of said cylindrical portion, wherein a height ($h_{c5}$) of said cylindrical portion of said anode side grid electrode of said central electron gun is selected to be $h_{c5} < 0.35D$ and a height ($h_{s5}$) of said cylindrical portion of said anode side grid electrode of each of said two side electron guns is selected to be $h_{s5} < 0.2D$, where D is the inside diameter of the cylindrical portion, and further wherein said anode side grid electrodes of said central and said two side electron guns are integrally formed only by means of a single cap electrode, without an inner electrode coupled to the cap electrode, so that the heights $h_{c5}$ and $h_{s5}$ are formed entirely by the cap electrode.

3. An electron gun assembly for a color picture tube comprising:

two side electron guns and a central electron gun sandwiched spacedly between said two side electron guns in an in-line relation; each of said central and said two side electron guns including a main focussing lens system comprised of a cathode side grid electrode, an anode side grid electrode and an intermediate grid electrode provided between said cathode side and said anode side grid electrodes, said cathode and anode side grid electrodes being kept at the same electric potential; said cathode side, said anode side and said intermediate grid electrodes of said main focussing lens system of each of said central electron gun and said two side electron guns having a cylindrical portion of the same inside diameter, respectively; a height of said cylindrical portion of each of the intermediate grid electrodes being selected to be substantially larger than said inside diameter of said cylindrical portion, wherein the relations, $h_{c3}$, $h_{c5}<0.37D$ and $h_{s3}$, $h_{s5}<0.43D$ are satisfied, where $h_{c3}$ and $h_{c5}$ are heights of said cylindrical portions of said cathode side and said anode side grid electrodes of said central electron gun, respectively, $h_{s3}$ and $h_{s5}$ are heights of said cylindrical portions of said cathode side and said anode side grid electrodes of each of said two side electron guns, respectively; and D is the inside diameter of the cylindrical portion, and further wherein said anode side grid electrodes of said central and said two side electron guns are integrally formed by means of a single cap electrode and said cathode side grid electrodes of said central and said two side electron guns are respectively integrally formed only by means of a single cap electrode, without inner electrodes coupled to the cap electrodes, so that the heights $h_{c3}$, $h_{c5}$, $h_{c5}$, are formed entirely by cap electrodes.

4. An electron gun assembly for a color picture tube as defined in claim 1 or 3, wherein the height ($h_{c3}$) of the cylindrical portion of said cathode side grid electrode of said central electron gun is less than the height ($h_{s3}$) of said cylindrical portion of the cathode side grid electrode of each of said two side electrodes.

5. An electron gun assembly for a color picture tube as defined in claim 2 or 3, wherein the height ($h_{c5}$) of the cylindrical portion of said anode side grid electrode of said central electron gun is greater than the height ($h_{s5}$) of the cylindrical portion of the anode side grid electrode of each of the two side electron guns.

* * * * *